US006644568B1

(12) United States Patent
Porter

(10) Patent No.: US 6,644,568 B1
(45) Date of Patent: Nov. 11, 2003

(54) FUEL INJECTOR WITH SPIRAL-WOUND SPRING ADJUSTMENT TUBE

(75) Inventor: David Lee Porter, Westland, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/279,241

(22) Filed: Oct. 24, 2002

(51) Int. Cl.[7] ..... B05B 1/30; F02M 51/00

(52) U.S. Cl. ..... 239/585.1; 239/533.9; 239/585.2; 239/585.3; 239/585.4; 239/585.5

(58) Field of Search ..... 239/585.1, 585.2, 239/585.3, 585.4, 585.5, 533.9

(56) References Cited

U.S. PATENT DOCUMENTS

| | | | | |
|---|---|---|---|---|
| 3,662,987 A | | 5/1972 | Schlagmuller et al. | |
| 4,934,605 A | | 6/1990 | Hans et al. | |
| 4,946,132 A | * | 8/1990 | Reiter | 239/585.4 |
| 5,165,656 A | | 11/1992 | Maier et al. | |
| 5,275,341 A | * | 1/1994 | Romann et al. | 239/585.4 |
| 5,301,874 A | * | 4/1994 | Vogt et al. | 239/585.4 |
| 5,360,197 A | | 11/1994 | Reiter et al. | |
| 5,433,386 A | | 7/1995 | Wieczorek et al. | |
| 5,577,663 A | * | 11/1996 | Nally et al. | 239/585.4 |
| 5,613,640 A | | 3/1997 | Furuya et al. | |
| 5,692,723 A | | 12/1997 | Baxter et al. | |
| 5,927,613 A | | 7/1999 | Koyanagi et al. | |
| 5,937,887 A | | 8/1999 | Baxter et al. | |
| 6,003,790 A | | 12/1999 | Fly | |
| 6,012,701 A | | 1/2000 | Reiter | |
| 6,257,509 B1 | | 7/2001 | Hafner et al. | |
| 6,464,153 B1 | * | 10/2002 | Bonnah et al. | 239/585.1 |
| 2001/0010341 A1 | * | 8/2001 | Koizumi et al. | 239/585.1 |

OTHER PUBLICATIONS

Spirol International Corporation, Spirol Engineered Components Apllications, copyright 2002, internet pages.*

* cited by examiner

*Primary Examiner*—Robin O. Evans
(74) *Attorney, Agent, or Firm*—Brinks Hofer Gilson & Lione

(57) ABSTRACT

A top-feed electronic fuel injector for an internal combustion engine includes an injector body having a valve seat disposed opposite a generally cylindrical bore of nominal inner diameter defined within the injector body. A needle valve moves within the passage between a closed position against the valve seat, as urged by a coil spring disposed within the bore, and an open position away from the valve seat. The coil spring is seated against an end face a spring adjustment tube that is pressed into the bore. The spring adjustment tube, which is formed of rolled sheet stock to provide a "spiral-wound" configuration featuring at least 1.5 turns, end-to-end, when the spring adjustment tube is viewed in a transverse section, resiliently presses against the walls of the bore to maintain its position and, hence, calibrate the spring force applied to the needle valve.

12 Claims, 1 Drawing Sheet

FUEL INJECTOR WITH SPIRAL-WOUND SPRING ADJUSTMENT TUBE

FIELD OF INVENTION

The invention relates to fuel injectors in which an injector needle valve is urged against a valve seat by a coil spring that otherwise bears against a spring-force adjustment element positioned within a complementary bore defined in the housing opposite the valve seat.

BACKGROUND OF THE INVENTION

Conventional automotive electronic fuel injectors for an internal combustion engine generally include an injector body defining an internal passage that extends between a fuel inlet and a fuel delivery nozzle. An annular electromagnetic coil assembly on the injector body encircles a portion of the passage, while an armature/needle valve assembly disposed within the passage is biased toward a valve seat by a coil spring that is also disposed within the passage. Upon energizing the electromagnetic coil assembly, a magnetic force is generated on the armature/needle valve assembly which operates against the action of the spring to move the assembly's needle valve away from the valve seat and thereby permit pressurized fuel to flow through the injector bore and out the injector nozzle.

In order to obtain a desired spring force biasing the armature/needle valve assembly against the valve seat, the prior art generally positions the spring within the injector passage such that one end of the spring bears directly against the valve armature. The other end of the spring is typically seated against a shoulder defined within the passage, as by an end face of a cylindrical spring-force adjustment element or "spring adjuster" that is permanently positioned in a complementary bore defined in the injector body opposite the valve seat. The spring adjuster may comprise a solid cylindrical pin or, alternatively, may be formed of tubular stock to thereby provide a "spring adjustment tube" that is particularly useful, for example, in the case of a top-feed fuel injector wherein fuel flows through the spring adjuster toward the nozzle.

The prior art teaches several approaches for retaining or securing the spring adjuster at a desired depth/position within the bore in order to achieve a desired bias on the armature/needle valve assembly. Under one approach, a slightly-larger-diameter cylindrical pin is pressed axially into the bore to a desired depth. The resulting interference fit between the pin and the bore serves to thereafter retain the pin at the desired location. Unfortunately, a substantial press force is required to insert the pin into the bore, thereby increasing manufacturing costs. Moreover, the bore may be damaged during the pressing operation, creating burrs or other defects on either the pin or the bore, further increasing the pressing force required for installation and making an accurate axial positioning of the pin in the bore more difficult to achieve. The radial interference between the press-fit pin and the bore may also cause undesirable distortion of the injector body.

Under another known approach, a slotted spring pin is pressed into the bore to a desired depth. Generally, a slotted spring pin is a hollow cylindrical tube formed of thin, rolled spring steel so as to have a longitudinal slot extending down its entire length. The slotted spring pin is manufactured to a controlled outside diameter slightly greater than the inlet tube of the injector. The longitudinal slot permits the slotted spring pin to be resiliently radially compressed during installation, after which the resilient spring material of the slotted spring pin applies continuous radial pressure against the bore to maintain the slotted spring pin at the desired depth. A chamfered end on the slotted spring pin is often used to facilitate radial compression during insertion, thereby reducing possible damage to the bore and lowering the required insertion force.

Unfortunately, a significant press force is still required during insertion in order to radially compress the slotted spring pin. And, because an installed slotted spring pin does not engage the bore about its entire periphery, a greater sheet thickness must be used to achieve a sufficient resilient engagement with the bore, further increasing the press force required to radially compress the slotted spring pin and insert it in the bore, as well as the likelihood of any attendant damage to, or dimensional distortion of, the bore. Additionally, unlike a solid or tubular pin, the end of the slotted spring pin does not provide a 3600 land or circumferentially-continuous shoulder about the bore against which the coil spring may bear.

Accordingly, what is needed is a spring adjuster for an electromagnetically-actuated fuel injector that exhibits a reduced insertion force while otherwise providing both a sufficient retention force within the bore, and whose longitudinal end preferably further provides a circumferentially-continuous annular surface against which the armature return spring can bear.

SUMMARY OF THE INVENTION

Under the invention, an electromagnetically-actuated fuel injector for supplying fuel to an internal combustion engine includes an injector body defining an internal passage that extends between an inlet and a fuel delivery nozzle. An annular electromagnetic coil is mounted on the injector body so as to encircle a portion of the passage, while a needle valve disposed within the passage is biased by a coil spring toward a valve seat defined within the passage proximate to the nozzle. The needle valve is movable, upon actuation of the electromagnetic coil, between a closed position in which the needle valve sealing engages the valve seat, and an open position in which the needle valve separates from the valve seat to permit fuel to flow through the nozzle.

In accordance with the invention, a spring adjustment tube is disposed within a generally-cylindrical bore defined in the housing opposite the valve seat. By way of example, in the case of a top-feed electronic fuel injector, the bore is defined by the inner diameter of an inlet tube that otherwise also defines the upper portion of the injector's internal passage. However, it will be appreciated that the invention contemplates forming a suitable bore in the injector body that does not form a part of a direct fuel flow path between, for example, an inlet defined on a side of the injector body and the nozzle. A coil return spring is disposed within the passage between the needle valve and an end face of the spring adjustment tube. The axial position of the spring adjustment tube within the inlet tube, relative to the valve seat, calibrates the return spring force applied to the needle valve.

Under the invention, the spring adjustment tube is formed from a square or, more preferably, rectangular section of relatively-thin sheet stock that is rolled to achieve a spiral-wound configuration having at least 1.5 turns, end-to-end, and preferably about 2.0 to 3.0 turns, end-to-end, when the spring adjustment tube is viewed in transverse section. Most preferably, the spring adjustment tube has about 2.25 turns, end-to-end, when viewed in transverse cross-section. The nominal outer diameter of the as-rolled spring adjustment tube is slightly greater than the nominal inner diameter of the injector's inlet tube.

In accordance with an aspect of the invention, the material properties and thickness of the relatively-thin sheet stock from which the precursor square or rectangular section is obtained, as well as the minor dimension to which a rectangular section is cut, is selected such that the rolled spring adjustment tube is both resiliently radially compressible to an outer diameter at least as small as the nominal inner diameter of the injector's inlet tube and resiliently presses against the bore upon insertion to thereby maintain the spring adjustment tube's relative position within the inlet tube.

Because the spring adjusting tube is "spiral-wound" when viewed in transverse section, with the outermost "turn" of sheet stock overlying at least part of an innermost "turn," the required resilient bending of the sheet stock during insertion is spread over a greater "length" of the stock's minor or "rolled" dimension. Further, the innermost "turns" advantageously provide a relatively-greater radial spring force for a given sheet thickness. Thus, the invention permits use of a thinner, more flexible sheet stock featuring a lower spring constant to achieve the desired resilient bias against the bore of the inlet tube, as compared to a prior art slotted spring pin, resulting in a substantial reduction in the press force required to insert the spring adjustment tube into the injector's inlet tube.

In this regard, it is noted that, while a number of turns greater than about 3.0 may be used in connection with the invention, it is believed that the increased difficulty associated with manufacturing spiral-wound adjustment tubes having more than three turns is likely to offset the performance gains from having more than three turns and, accordingly, the number of turns employed when practicing the invention is preferably no greater than about 3.0 turns.

As a further benefit, the reduced insertion force reduces the likelihood of damage to either the spring adjustment tube or the injector's inlet tube during insertion of the spring adjustment tube into the inlet tube, thereby facilitating precise axial placement of the spring adjustment tube relative to the valve seat for coil spring-force calibration. The more flexible sheet stock used in manufacture of the spring adjustment tube is also believed to be more tolerant of dimensional variation in the nominal inner diameter of the inlet tube, thereby permitting a reduction in manufacture costs associated with the inlet tube, while otherwise ensuring that a desired radial retention force will be obtained within the inlet tube.

In accordance with yet another aspect of the invention, where the nominal diameter or thickness of the wire stock, from which the coil spring is wound, exceeds the thickness of the sheet stock from which the spiral-wound spring adjustment tube is rolled, the end face of the spiral-wound adjustment tube advantageously defines a continuous circumferential surface against which the spring bears.

Other objects, features, and advantages of the present invention will be readily appreciated upon a review of the subsequent description of the preferred embodiment and the appended claims, taken in conjunction with the accompanying drawings.

DETAILED DESCRIPTION OF THE PREFERRED EMBODIMENT

Figure 1:
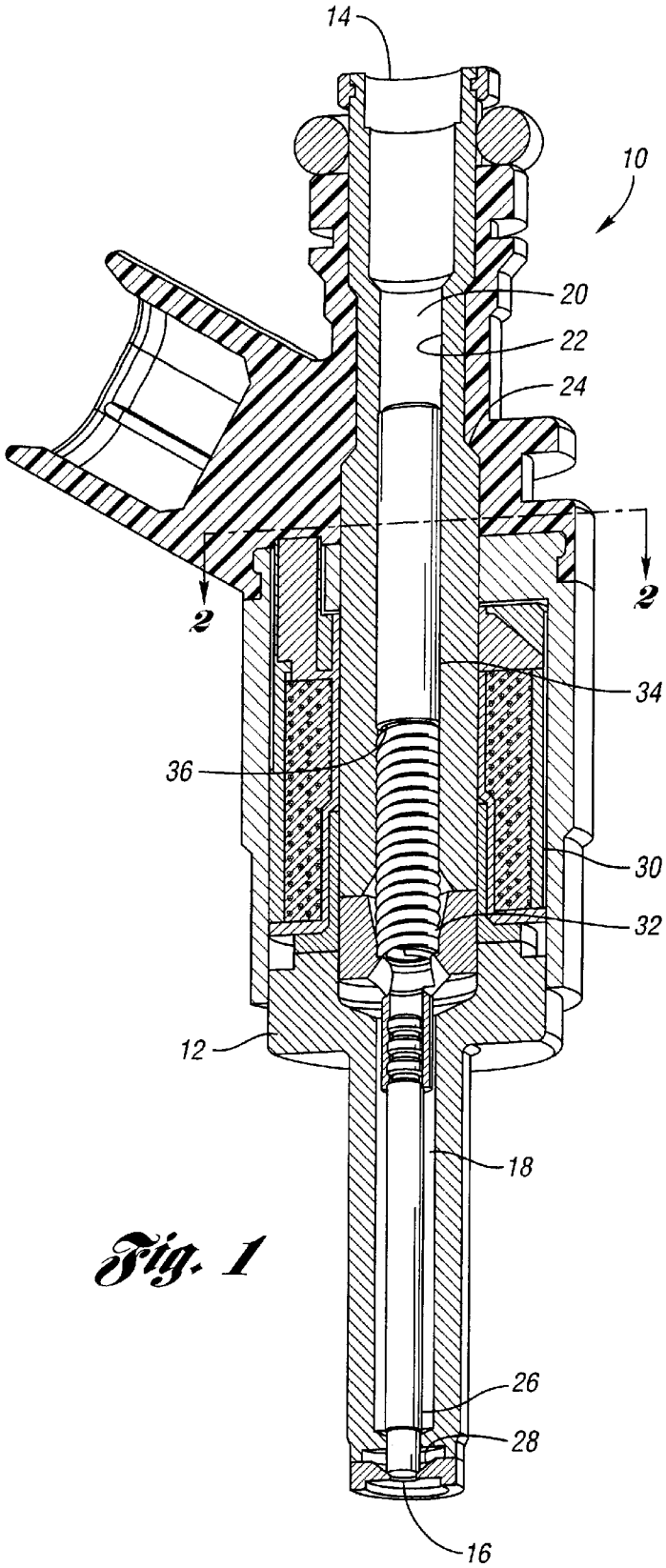
FIG. 1 is an axial cross-sectional view of a fuel injector in accordance with the invention.

Referring to FIG. 1, an electromagnetically-actuated top-feed electronic fuel injector 10 in accordance with the invention includes an injector body 12 having a fuel inlet 14 and a fuel exit nozzle 16. An internal passage 18 extends between the fuel inlet 14 and the nozzle 16, an upper portion 20 of which is defined by an inner diameter 22 of a smooth-bore inlet tube 24 incorporated into the injector body 12. A needle valve 26 is disposed within a lower portion of the passage 18, downstream of the inlet tube 24 and proximate to a valve seat 28 defined within the passage. The needle valve 26 is movable within the passage between a closed position characterized by a sealing engagement of the needle valve 26 with the valve seat 28, and an open position that permits the flow of fuel through the passage past the valve seat 28 and out the nozzle 16. Movement of the needle valve 26 is controlled by an annular electromagnetic coil 30 on the injector body 12 that encircles the passage 18, and by a return coil spring 32 disposed within the passage 18 upstream of the needle valve 26 that urges the needle valve 26 against the valve seat 28.

In accordance with an aspect of the invention, as best seen in FIG. 1, a spring adjustment tube 34 is disposed within the inlet tube 24 such that an end face 36 of the spring adjustment tube 34 defines a surface against which the coil spring 32 axially bears. The axial position of the spring adjustment tube 34 within the inlet tube 24, relative to the valve seat 28, calibrates the return spring force applied to the needle valve 26.

Figure 2:
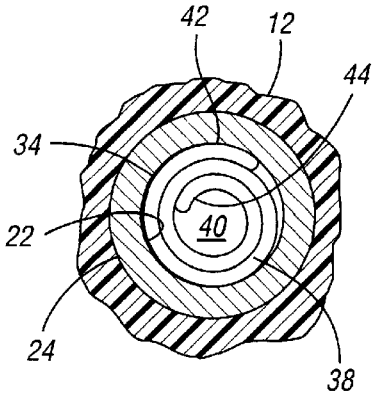
FIG. 2 is an enlarged transverse section view of the fuel injector taken along line 2—2 of FIG. 1.
Figure 3:
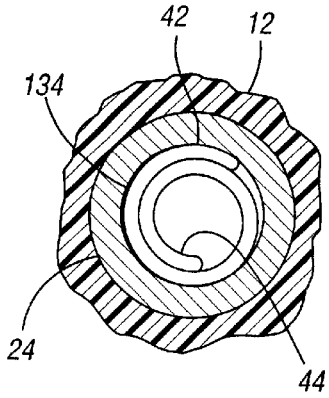
FIG. 3 is an enlarged transverse section of a second fuel injector, similar to that of FIG. 2, showing a second spiral-wound spring adjuster in accordance with the invention.

As best seen in FIG. 2, the spring adjustment tube 34 has a spiral-wound configuration when viewed in transverse section. The spring adjustment tube 34 is formed from a rectangular section of relatively-thin sheet stock 38 that is rolled along a minor dimension to thereby obtain an elongated spiral-wound tube configuration with roughly 2.25 turns, "end-to-end" along the rolled minor dimension, when viewed in transverse section. By way of example only, a coiled spring pin having about 2.25 turns and formed of a corrosion-resistant material, suitable for use as the spring adjustment tube 34 in accordance with the invention, is available from the Spirol® Precision Engineered Products of Danielson, Connecticut. FIG. 3 shows an alternative spiral-wound spring adjustment tube 134 in accordance with the invention, having roughly 1.5 turns, end-to-end, when viewed in transverse section.

Prior to insertion of the spring adjustment tube 34 into the injector's inlet tube 24, the as-rolled spring adjustment tube 34 has a nominal outer diameter slightly greater than the nominal inner diameter 22 of the inlet tube 24. Once installed within the inlet tube 24, the rolled, spiral-wound configuration of the spring adjustment tube 34 advantageously provides a central axial passage 40 defining a portion of the fuel flow passage 18 extending between the injector's fuel inlet 14 and the fuel exit nozzle 16.

In accordance with an aspect of the invention, the material properties and thickness of the relatively-thin sheet stock 38 from which the precursor rectangular section is obtained, as well as the minor dimension to which the rectangular section is cut, is selected such that the rolled spring adjustment tube 34 is both resiliently radially compressible to an outer diameter at least as small as the nominal inner diameter 22 of the injector's inlet tube 24 and resiliently presses against the inlet tube's inner diameter 22 upon insertion to thereby maintain the spring adjustment tube's relative position within the inlet tube 22. As noted above, the sheet stock 38 is preferably formed of a corrosion-resistant material, in view of the service environment in which the spring adjustment tube 34 will operate.

Referring again to FIG. 2, because the spring adjustment tube 34 is "spiral wound" when viewed in transverse section, such that the outermost "turn" 42 of sheet stock overlies more than one inner "turn" 44, the required resilient bending of the sheet stock during insertion is spread over a greater "length" of the stock's rolled minor dimension. Thus, the invention permits use of a thinner, more flexible sheet stock 38 featuring a lower spring constant as compared to a prior art slotted spring pin.

Moreover, the innermost turns 44 advantageously provide a relatively-greater radial spring force for a given sheet thickness, permitting further reductions in the thickness of the sheet stock 38 used in manufacturing the spiral-wound spring adjustment tube 34 as an increasing number of turns is used.

Use of the spiral-wound spring adjusting tube 34 advantageously permits a substantial reduction in the press force required to insert the spring adjustment tube 34 into the inlet tube 24, as compared to that required to insert prior art slotted spring pin. The reduced insertion force, in turn, results in a reduced likelihood of damage to either the spring adjustment tube 34 or the inlet tube 24 during the press-in operation. As yet another benefit, the more flexible sheet stock 38 used in manufacture of the spiral-wound spring adjustment tube is further believed to be more tolerant of dimensional variation in the nominal inner diameter 22 of the inlet tube 24, thereby permitting a reduction in manufacture costs associated with the inlet tube 24 while otherwise ensuring that a desired radial retention force will be achieved by the spring adjustment tube 34 within the inlet tube 24.

Because a lower press force is advantageously used to insert the spring adjustment tube 34 to a desired relative position within the inlet tube 24, and because there is a substantially reduced likelihood of burr or nib formation that might impede such precise axial positioning of the spring adjustment tube 34, the invention beneficially provides for a more accurate calibration of the return spring force applied by the coil spring 32 to the needle valve 26.

In accordance with yet another aspect of the invention, the coil spring 32 is wound from a wire stock whose diameter or thickness significantly exceeds the thickness of the sheet stock 38 from which the spiral-wound spring adjustment tube 34 is rolled. The relatively-thicker coil spring stock thus engages plural radial "layers" of the rolled sheet stock 38 forming the end face 36 of the spring adjustment tube 34, such that the end face 36 of the spring adjustment tube 34 may be said to define a "continuous" circumferential surface against which the coil spring 32 bears. By way of example, providing such a 360° engagement between the end face 36 of the spring adjustment tube 34 and the corresponding end of the coil spring 32 reduces any likelihood of the coil spring 32 tipping or becoming "cocked" within the passage 18.

While the above description constitutes the preferred embodiment, it will be appreciated that the invention is susceptible to modification, variation and change without departing from the proper scope and fair meaning of the subjoined claims.

I claim:

1. An electromagnetically-actuated fuel injector for supplying fuel to an internal combustion engine comprising:

an injector body having a fuel inlet, a fuel exit nozzle, and an internal passage extending from the inlet to the nozzle through a valve seat, the injector body further including a generally-cylindrical bore having a nominal inner diameter opposite the valve seat;

an electromagnetic coil on the injector body encircling the passage;

a needle valve in the passage proximate to the valve seat, the needle valve being moveable upon actuation of the electromagnetic coil between a closed position in which the needle valve sealing engages the valve seat, and an open position in which the needle valve separates from the valve seat to permit fuel to flow through the nozzle;

an elongated spring adjustment tube disposed within the bore of the injector body opposite the valve seat, the spring adjustment tube including an end face opposing the valve seat; and a coil spring disposed within the passage between the needle valve and the end face of the spring adjustment tube, wherein the spring bears against the end face of the spring adjustment tube to resiliently bias the needle valve toward the valve seat, wherein the spring adjustment tube is rolled from a section of a relatively-thin sheet stock to thereby obtain a spiral-wound spring adjustment tube having at least about 1.5 turns when the spring adjustment tube is viewed in a transverse section, the spring adjustment tube having a nominal as-rolled outer diameter slightly greater than the nominal inner diameter of the bore in the injector body, and the spring adjustment tube being resiliently radially collapsible to a collapsed outer diameter smaller than the nominal inner diameter of the bore in the injector body, whereby the spring adjustment tube resiliently presses against the bore to thereby maintain the spring adjustment tube in a predetermined position within the bore relative to the valve seat.

2. The fuel injector of claim 1, wherein the spring adjustment tube has at least about 2.0 turns when the tube is viewed in the transverse section.

3. The fuel injector of claim 2, wherein the spring adjustment tube has no more than about 3.0 turns when the tube is viewed in the transverse section.

4. The fuel injector of claim 2, wherein the spring adjustment tube has about 2.25 turns when viewed in the transverse section.

5. The fuel injector of claim 1, wherein the sheet stock is formed of a corrosion-resistant spring steel.

6. The fuel injector of claim 1, wherein the sheet stock has a nominal diameter, and wherein the coil spring is formed of a wire stock having a nominal thickness significantly greater than the nominal thickness of the sheet stock, whereby the end face of the spring adjustment tube defines a continuous circumferential surface against which an end of the coil spring bears.

7. A top-feed fuel injector for supplying fuel to an internal combustion engine comprising:

an injector body having an inlet for admitting fuel into said injector, a nozzle for injecting fuel into the engine, and an internal passage extending from the inlet to the nozzle, wherein a first portion of the passage proximate to the nozzle is defined by a valve seat, and wherein a second portion of the passage is defined by an inner diameter of a generally cylindrical inlet tube;

an electromagnetic coil on the injector body;

a needle valve disposed within the passage proximate to the valve seat, the needle valve being moveable upon actuation of the electromagnetic coil between a closed position in which the needle valve sealing engages the valve seat, and an open position in which the needle valve separates from the valve seat to permit fuel to flow through the nozzle;

an elongated spring adjustment tube disposed within the bore of the injector body opposite the valve seat, the spring adjustment tube including an end face opposing the valve seat; and a coil spring disposed within the passage between the needle valve and the end face of the spring adjustment tube, wherein the spring bears against the end face of the spring adjustment tube to resiliently bias the needle valve toward the valve seat, wherein the spring adjustment tube is formed from a rectangular section of a relatively-thin sheet stock that is rolled along a minor dimension to thereby obtain an elongated spiral-wound spring adjustment tube having at least about 1.5 turns when the spring adjustment tube is viewed in a transverse section, the spring adjustment tube having a nominal as-rolled outer diameter slightly greater than the inner diameter of the inlet tube and being resiliently radially collapsible to a collapsed outer diameter smaller than the nominal inner diameter of the bore in the injector body, whereby the spring adjustment tube resiliently presses against the bore in the injector body to thereby maintain the spring adjustment tube in a predetermined position within the inlet tube in the injector body relative to the valve seat.

8. The fuel injector of claim 7, wherein the spring adjustment tube has at least about 2.0 turns when the tube is viewed in the transverse section.

9. The fuel injector of claim 8, wherein the spring adjustment tube has no more than about 3.0 turns when the tube is viewed in the transverse section.

10. The fuel injector of claim 8, wherein the spring adjustment tube has about 2.25 turns when viewed in the transverse section.

11. The fuel injector of claim 7, wherein the sheet stock is formed of a corrosion-resistant spring steel.

12. The fuel injector of claim 7, wherein the sheet stock has a nominal thickness, and wherein the coil spring is formed of a wire stock having a nominal diameter significantly greater than the nominal thickness of the sheet stock, whereby the end face of the spring adjustment tube defines a continuous circumferential surface against which an end of the coil spring bears.

* * * * *